United States Patent [19]

Bixler et al.

[11] Patent Number: 4,713,023

[45] Date of Patent: Dec. 15, 1987

[54] ELECTRICAL CONNECTOR AND METHOD OF ASSEMBLY

[75] Inventors: Craig A. Bixler, Elmhurst; Irvin R. Triner, Stickney, both of Ill.

[73] Assignee: Molex Incorporated, Lisle, Ill.

[21] Appl. No.: 9,314

[22] Filed: Jan. 30, 1987

[51] Int. Cl.[4] ..... H01R 4/04

[52] U.S. Cl. ..... 439/393; 439/610

[58] Field of Search ..... 439/389, 391, 393, 417, 439/607, 610

[56] References Cited

U.S. PATENT DOCUMENTS

| | | | |
|---|---|---|---|
| 4,211,462 | 7/1980 | Wolfthal | 439/391 |
| 4,415,223 | 11/1983 | Asick | 439/610 |
| 4,449,778 | 5/1984 | Lane | 439/610 |

*Primary Examiner*—Joseph H. McGlynn

*Attorney, Agent, or Firm*—Louis A. Hecht

[57] ABSTRACT

A shielded plug assembly for mating a shielded multiconductor cable assembly to a shielded receptacle connector and the method of making the same. The plug assembly employs a new type of unitary molded wire positioning member to position and secure the conductors prior to and during insertion of the wire positioning member into the plug assembly housing. The method includes cutting the wires after positioning within the wire positioning member and deforming a portion of the wire positioning member to securely hold the conductors therein. When the plug assembly is terminated to the conductors, the cooperation of the wire positioning member and the plug housing are such that the conductor ends are moved within the housing to assure alignment with corresponding insulation penetrating type terminals.

19 Claims, 14 Drawing Figures

ELECTRICAL CONNECTOR AND METHOD OF ASSEMBLY

BACKGROUND OF THE INVENTION

1. Field of the Invention

The present invention relates to an electrical connector and a method of assembling discrete wires in a predetermined arrangement within an electrical connector housing. This invention also relates to a shielded electrical arrangement and a method for making the same.

2. Brief Description of the Prior Art

It is very common to mass terminate a plurality of insulated conductors to a connector. The conductors may be provided for mass termination in a variety of forms. In round conductor ribbon cable, for example, discrete wire conductors are disposed in parallel spaced relation to each other between insulating dielectric layers which surround and insulate the wires and form webs of insulation between them. Alternatively, conductors may be provided in the form of a multi-cable assembly plurality of insulated conductors surrounded by an outer insulation jacket of a generally round cross section. This latter type of cable assembly presents problems that are absent when dealing with round conductor ribbon cable. When using a ribbon cable, the intervening webs serve to maintain the relative position and spacing of adjacent conductors. On the other hand, when handling discrete wire, the insulated conductors must first be unravelled from a bundle of wires and thereafter positioned in such a manner to permit mass termination with a plurality of terminals.

One means of connecting the discrete wires of a multi-conductor cable assembly to a plug assembly is disclosed in U.S. Pat. No. 4,601,530. In that patent, the plug assembly includes an insulated housing which has a front mating end and a rear wire receiving end which join opposing top and bottom walls. The housing includes a generally planar trough extending from a wire receiving opening in the rear end towards the front end of the housing and a plurality of terminal receiving cavities extending from the top wall into the trough near the front end thereof. Insulative wire positioning means is provided to be received in the wire receiving opening into the trough to hold the insulated conductors in a generally planar array so that the ends thereof are presented in alignment below the terminal receiving cavities when the positioning means is in the housing trough. A plurality of insulation penetrating terminals are mounted in the terminal receiving cavities and movable toward the trough to engage the conductors aligned thereunder. The wire positioning means disclosed in U.S. Pat. No. 4,601,530 is a comb-like wire holder with a series of staggered wire locating apertures. The reason why the apertures must be staggered is that the upstanding resilient fingers separating adjacent apertures take up too much space to allow all of the insulated conductors to be in the same plane.

In the above cited arrangement, it is is essential that the end of a particular conductor not extend past the wire holder structure too far or too little. Otherwise, it is possible that the conductor will not be properly terminated. Thus, the wire positioning structure of U.S. Pat. No. 4,601,530 provides that the apertures be large enough to allow the wires to have a sliding fit therein. Once the structure is received within the plug housing prior to termination, the wires are still axially and slidably movable. This permits last moment realignment prior to termination, but also permits inadvertent misalignment because the wires are not positively held in position. This is particularly important where the plug assembly is to be assembled by a customer in a production environment.

The same drawbacks are apparent in the wire positioning means which is disclosed in U.S. Pat. No. 4,577,920. The plug assembly described in this patent includes a shielded connector assembly which positions a multi-conductor shielded cable assembly within a plug housing. Once again, the conductors are not positively held in position to prevent misalignment prior to termination.

U.S. Pat. No. 4,516,822 discloses a connector assembly which positively positions the wires prior to termination. However, the wire positioning structure comprises two small separate component parts. This is undesireable because of the inherent dual deficiencies of being difficult to handle and uneconomical to automate.

U.S. Pat. No. 4,636,024 discloses a wire positioning adapter for use in the plug connector of the type contemplated that positively holds the conductors in place. The adapter has a plurality of wire receiving holes formed in the adapter. The adapter is then deformed against the wires prior to insertion into a plug housing. This design does not lend itself to using wire on closely spaced centers because of the necessity of employing wire insertion holes to position the wires. In addition, there is no means of ensuring that the adapter is fully seated in the cavity formed in the housing such that the wire ends are properly positioned below the terminals.

In terminating shielded multi-conductor cable assemblies a conductive metal foil interposed between the bundle of discrete insulated conductors and the outer insulation jacket is electrically connected to a conductive shield on the plug housing. The plug shield in turn, is intended to mate with a conductive shield provided on a receptacle which is adapted to mateably receive the shielded plug assembly. This is typical of an input/output connector assembly used for the transmission of data. In such an application, it is necessary to provide a metal shield or shell around the plug housing which interconnects the cable foil with the receptacle ground.

It is desired that the metal shell be preassembled to the plug housing. In this manner, the customer does not have to worry about a loose part to apply correctly onto his assembly. In addition, it is desireable to have a one-piece shell for ease of handling and assembly at the factory. The round shaped configuration of multi-conductor shielded cable assemblies requires that the metal shell have a neck portion from which the unstripped portion of the cable assembly extends. The neck portion contacts the cable foil.

An example of a one-piece metal shell for an electrical connector is disclosed in U.S. Pat. No. 4,457,576. Unfortunately, however, the one-piece shield design illustrated in this patent cannot be used to provide the plug assembly with the metal shield or shell premounted.

SUMMARY OF THE INVENTION

It is, therefore, a principal object of the present invention to provide a new and improved plug assembly for connecting a round multiconductor cable assembly to a receptacle that is easier to assemble with a high degree of quality.

According to one aspect of this object of the invention there is provided a plug assembly for connecting a multiconductor cable assembly to a receptacle, said multiconductor cable assembly including a plurality of insulated conductors surrounded by an outer insulation jacket, said plug assembly being of the type including an insulated housing having a front mating end and a rear wire receiving end joining opposing top and bottom walls and an opposing pair of side walls and further including a generally planar trough extending from a wire receiving opening in the rear end towards the front end of the housing, a plurality of terminal receiving cavities extending from the top wall into said trough near the front end thereof and a strain relief section formed in the top wall betwen the terminal receiving cavities and the rear end and extending generally over the width of the trough and deformable downwardly into the trough upon receiving as downward force, insulative wire positioning means received through the wire receiving opening into the trough and holding said insulated conductors in an array so that the ends thereof are presented in alignment below said terminal receiving cavities when the wire loaded positioning means is in the housing trough, and a plurality of insulation penetrating terminals mounted in the terminal receiving cavities and moveable toward the trough to engage the conductors aligned thereunder;

the improvement comprising:

said positioning means includes cam means formed thereon adapted to engage said housing strain relief section when it is moved downwardly, whereby said positioning means is moved forwardly in the trough to fully seat the positioning means therein and position the free ends of the insulated conductors below said terminals.

According to another aspect of the object there is provided a method of producing a plug assembly for connecting multiconductor cable assembly to a receptacle, said multiconductor cable assembly including a plurality of insulated conductors surrounded by an outer insulation jacket, said plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, and a plurality of insulation penetrating terminals mounted in the terminal receiving cavities and moveable toward the trough to engage the conductors aligned thereunder, the method including the steps of:

(a) providing the housing with the terminals loaded in the cavities in a nonterminated position;

(b) stripping a portion of the insulation jacket from the cable to expose the insulated conductors;

(c) positioning the wire conductors into a planar array;

(d) positioning the array into the positioning means so that all of the ends of the conductors extend forwardly of said positioning means at a first predetermined distance;

(e) holding said array relative to said positioning means;

(f) inserting the positioning means into the housing trough so that the conductor ends are generally below and aligned with said terminals; and (g) terminating the conductors by imparting a downward force on the terminals to move them downwardly into the trough to engage said conductors;

the improvement in said method comprising performing the following steps prior to terminating the conductors:

(1) providing a unitary positioning means including two spaced-apart side walls, a wire support floor defined between the opposed interior surfaces of the side walls and top wall means spaced from said floor;

(2) positioning the array so that it is generally planar and all of the ends of the conductors extend forwardly of said positioning means at least said predetermined distance; and (3) cutting the planar array said predetermined distance from said positioning means and simultaneously deforming said positioning means to positively hold said conductor ends in said planar array.

It is another principal object of the present invention to provide a new and improved shielded plug assembly for connecting a round shielded multi-conductor cable assembly to a shielded receptacle that is easier to assemble with a high degree of quality.

One aspect of the present invention provides a shielded cable assembly for connecting a shielded multiconductor assembly to a receptacle, said shielded multiconductor cable assembly including a plurality of insulated conductors received within a cable shield and surrounded by an outer insulation jacket, said shielded plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, a plurality of insulation penetrating terminals mounted in the terminal receiving cavities and moveable toward the trough to engage the conductors aligned thereunder, conductive connector shield means mounted on and generally surrounding at least the top wall, bottom wall and sidewalls of the housing, said connector shield means including a generally converging neck portion extending rearwardly of said housing and surrounding said cable and adapted to contact said cable shield, and a ring member adapted to be crimped around the neck portion of the connector shield means to mechanically secure the cable to the housing and provide a strain relief therefor and to electrically connect the cable shield to the connector shield means, the improvement comprising:

said connector shield means includes an open ended, laterally enclosed, unitary, stamped metal shell slidingly mounted on said housing, said housing and metal shell having detent means for accurately locating the shell on the housing.

According to another aspect of this object of the invention, there is provided a method of producing a shielded plug assembly for connecting a shielded multi-conductor cable assembly to a receptacle, said multi-conductor cable assembly including a plurality of insulated conductors received within a cable shield and surrounded by an outer insulation jacket, said shielded plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, a plurality of insulation penetrating terminals mounted in the terminal receiving cavities and moveable toward the trough to engage the conductors aligned thereunder, conductive connector shield means mounted on and generally surrounding at least the top wall, bottom wall and sidewalls of the housing, said connector shield means including a generally converging neck portion extending rearwardly of said housing and surrounding said cable and adapted to contact said cable shield, and a ring member adapted to be crimped around the neck portion of the connector shield means to mechanically secure the cable to the housing and provide a strain relief therefor and to electrically connect the cable shield to the connector shield means;

the method including the steps of:

(a) providing the housing with the terminals loaded in the cavities in a nonterminated position;

(b) stripping a portion of the insulation jacket from the cable to expose the cable shield and the insulated conductors;

(c) positioning the wire conductors into said array;

(d) positioning the array into the positioning means so that all of the ends of the conductors extend forwardly of said positioning means at a first predetermined distance;

(e) holding said array relative to said positioning means;

(f) inserting the positioning means into the housing trough so that the conductor ends are generally below and aligned with said terminals;

(g) terminating the conductors by imparting a downward force on the terminals to move them downwardly into the trough to engage said conductors;

(h) mounting the connector shield means on the housing;

the improvement in said method comprising performing the following steps prior to terminating the conductors:

(1) stamping and forming said connector shield means to produce an open ended, laterally enclosed, unitary metal shell with the neck portion including a pair of semi-cylindrical neck members joined to the shell by means of a weakened coined seam line;

(2) sliding the shell onto the housing and pivoting said neck members away from each other about the respective seam lines;

(3) providing a unitary positioning means including two spaced-apart side walls, a wire support floor defined between the opposed interior surfaces of the side walls and top wall means spaced from said floor;

(4) positioning the array so that it is generally planar and all of the ends of the conductors extend forwardly of said positioning means at least said predetermined distance;

(5) cutting the planar array said predetermined distance from said positioning means; and (6) inserting said positioning means between said spread-apart neck members into said trough.

DESCRIPTION OF THE PREFERRED EMBODIMENT

Figure 1:
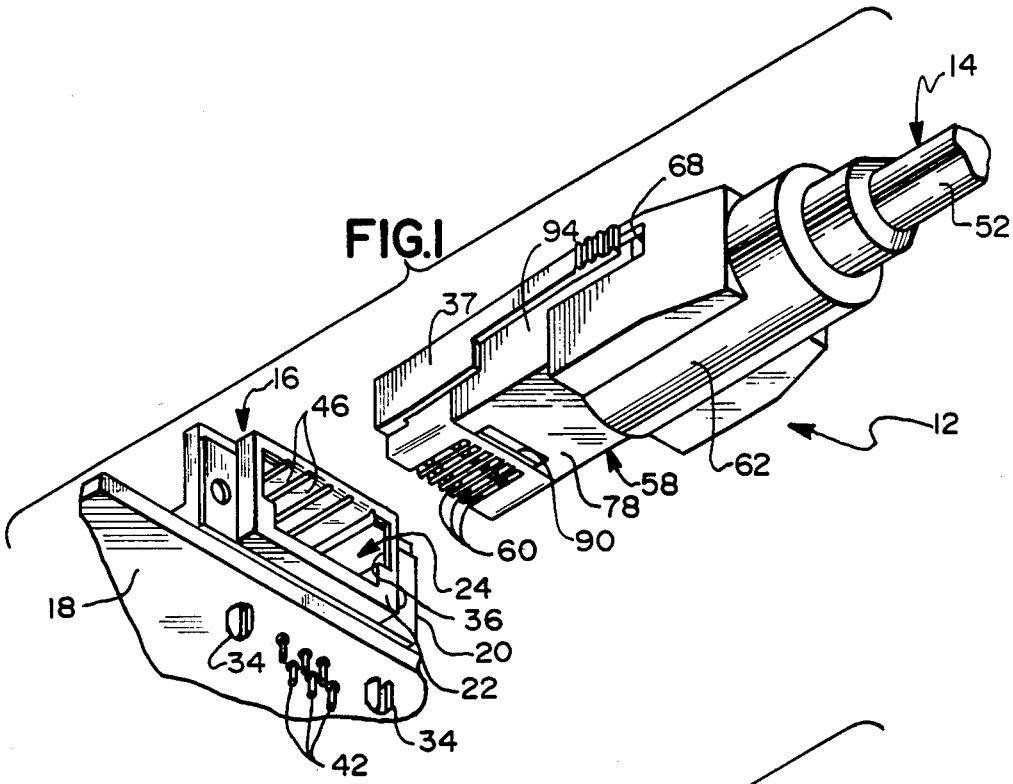
FIG. 1 is an exploded perspective view of the plug assembly of the present invention and its mating receptacle prior to engagement.
Figure 2:
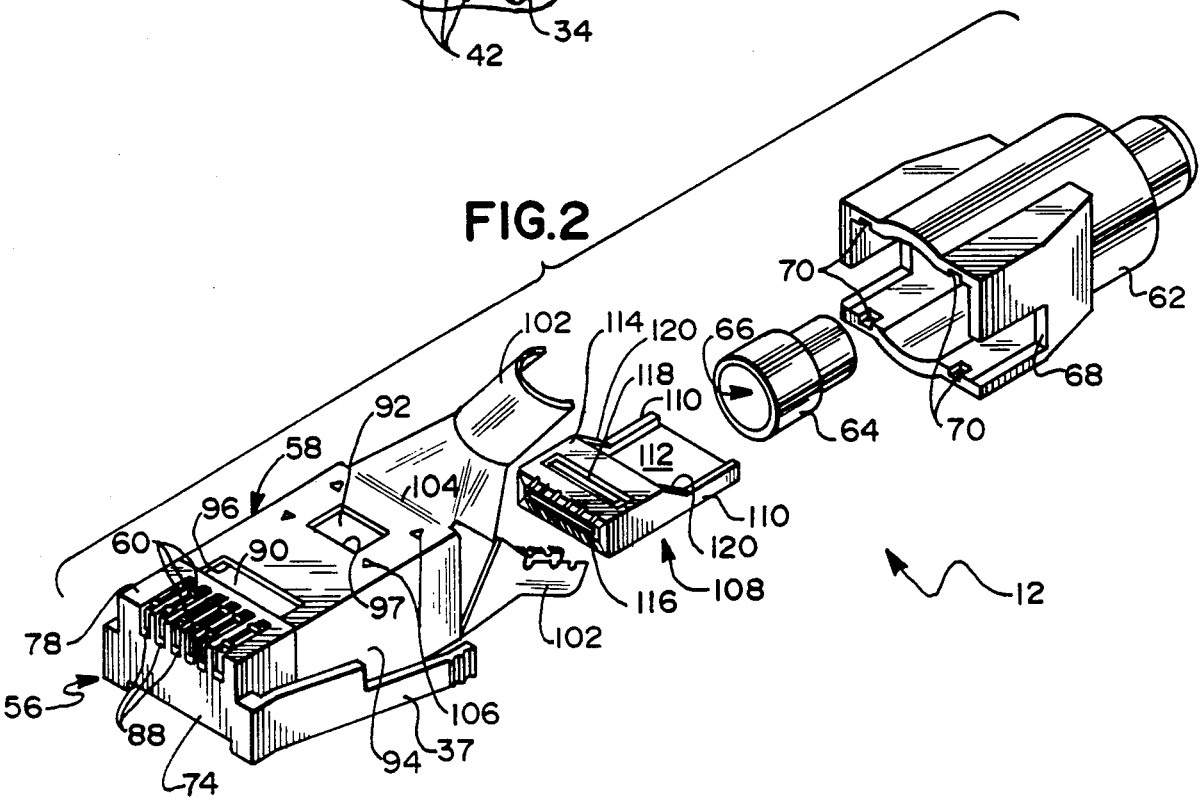
FIG. 2 is an exploded perspective view of the plug assembly of the present invention.

Turning to the figures in greater detail, FIG. 1 shows the plug assembly of the present invention, generally designated 12, which connects a multi-conductor shielded cable assembly, generally designated 14, to a shielded receptacle, generally designated 16. The receptacle 16 is adapted to be mounted on a printed circuit board 18.

Figure 3:
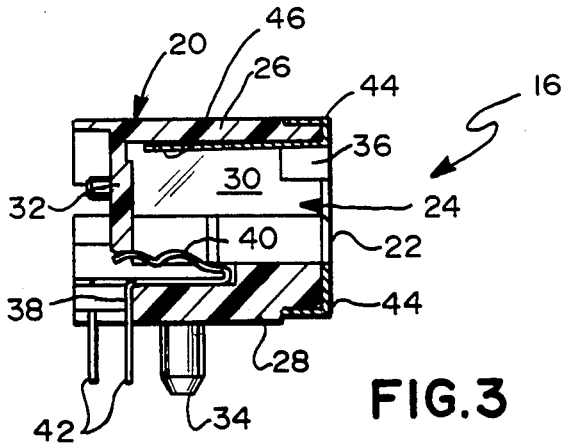
FIG. 3 is a side sectional view of a receptacle which mates with the plug assembly of the present invention.

As shown in FIGS. 1 and 3, the receptacle 16 is seen to generally include a housing 20 having a front mating end 22 with an opening 24 leading into a plug receiving socket. The socket is defined between a top wall 26, a bottom wall 28, two side walls 30 and a rear wall 32.

The bottom wall 28 has two depending mounting posts 34 to engage the printed circuit board 18 and to provide the means of mounting the receptacle 16 on the board. The side walls 30 each have recesses 36 formed therein to cooperate with laterally and rearwardly extending latch arms 37 formed on opposite sides of the plug assembly 12.

The receptacle 16 has a plurality of stamped and formed metallic contacts, generally designated 38. Each contact 38 has a spring mating end 40 adapted to electrically connect with the plug assembly 12 and a solder tail portion 42 extending from the bottom wall 28 to electrically connect with circuitry (not shown) formed on the printed circuit board 18.

Finally, the receptacle 16 has a stamped and formed metallic shield 44 which is mounted on the receptacle housing 20. The receptacle shield 44 has a portion 46 adapted to engage shielding means mounted on the plug assembly 12 as will be discussed in greater detail hereinafter.

Figure 4:
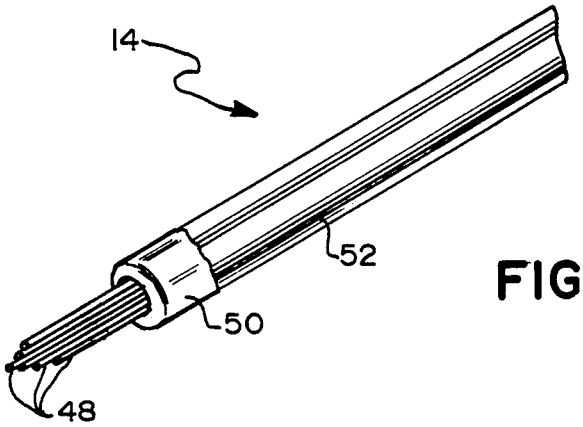
FIG. 4 is a perspective view of the end of a shielded multi-conductor cable which is to be terminated to the plug assembly of the present invention.

Turning now to FIG. 4 in greater detail, the multi-conductor shielded cable assembly 14 is seen to generally comprise a plurality of discrete insulated conductors 48 which are surrounded by a conductive metallic foil 50. The foil 50 acts as a shield for the cable assembly 14. An outer circular insulation jacket 52 surrounds the foil 50.

Initially, the end of the cable assembly 14 is stripped to expose the ends of the insulated conductors 48 as well as the conductive foil 50. The foil 50 is then turned back on itself over the outside surface of the insulation jacket 52 as is best shown in FIG. 4. The cable assembly 14 is now in a form to be connected to the plug assembly 12.

Figure 8:
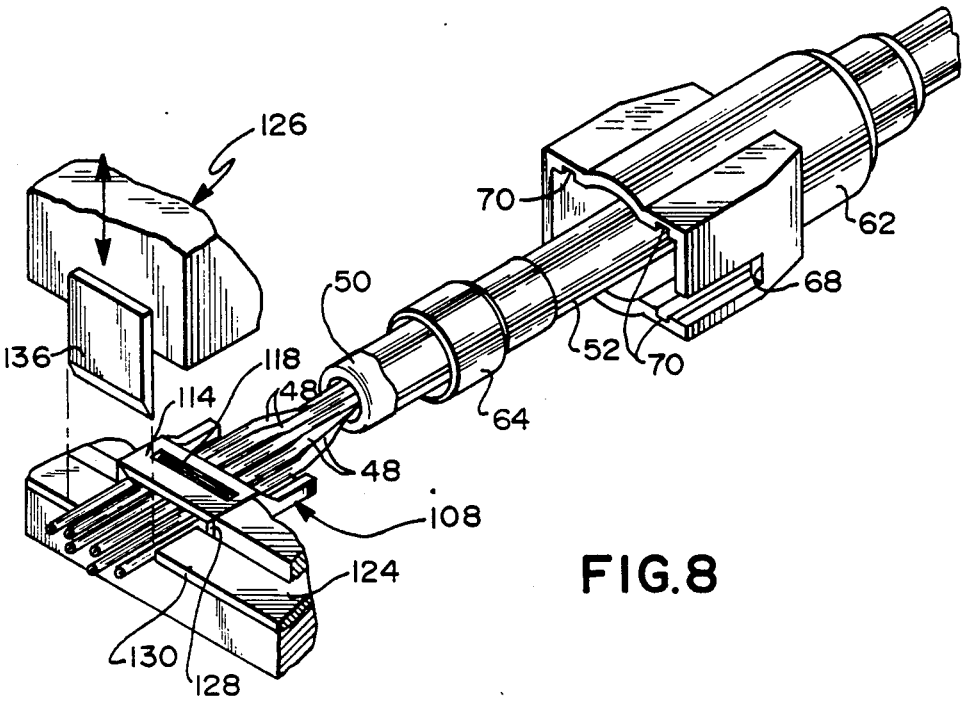
FIG. 8 is a perspective view of the end of a shielded multi-conductor cable assembly arranged within the wire positioning member and placed in a suitable application tool.

The plug assembly 12 is seen to generally include a plug housing, generally designated 56, which mounts a grounding shield in the form of a unitary stamped and formed metallic shell, generally designated 58, around the housing 56 and a plurality of insulation piercing terminals 60 within the housing 56. Also, included is a shield cover 62 and a ring member 64. The shield cover 62 is initially slipped onto the end of the cable assembly 14 through a cable receiving opening 66 followed by slidingly mounting ring member 64 thereon to achieve the configuration as best shown in FIG. 8. The shield cover 62 is provided for slots 68 to allow for clearance for the latch arms 37 and means 70 cooperating with the shell 58 to mount the shield cover 62 thereon.

The plug housing 56 is seen to generally include a front mating end 74, a rear wire receiving end 76 a top wall 78 a bottom wall 80 and two side walls 82. A generally planar wire receiving trough 84 is formed through a wire receiving opening, generally designated 86, in the rear wire receiving end 76.

Figure 6:
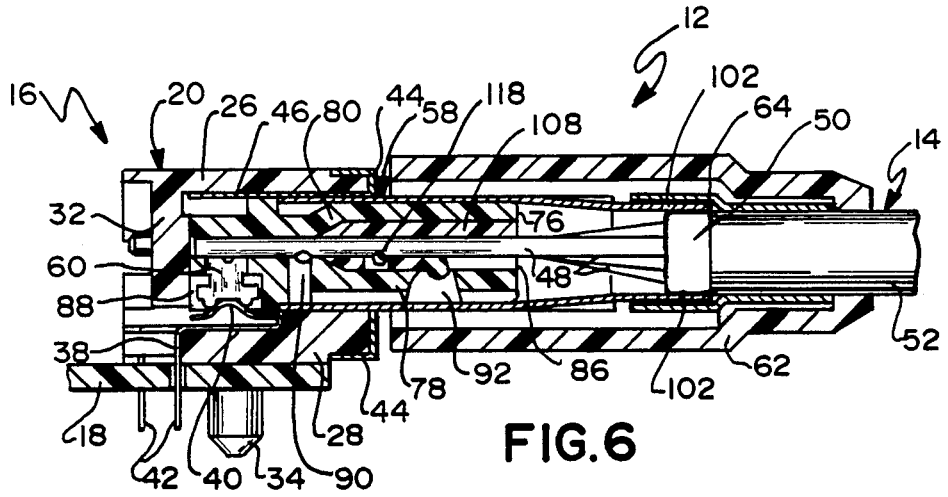
FIG. 6 is a side sectinal view of the plug assembly of the present invention received within its mating receptacle.
Figure 11:
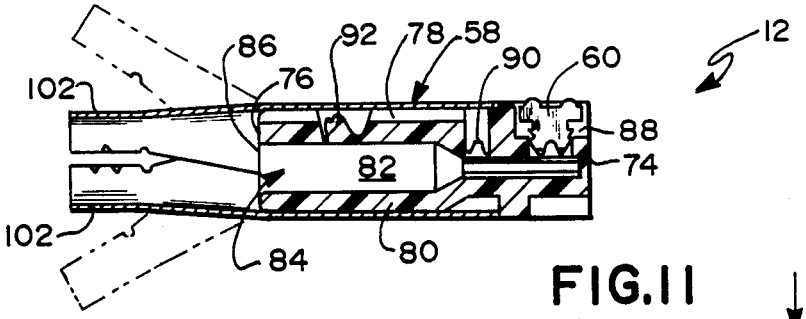
FIG. 11 is a side sectional view of the plug assembly of the present invention prior to the insertion of the wire positioning member subassembly.
Figure 12:
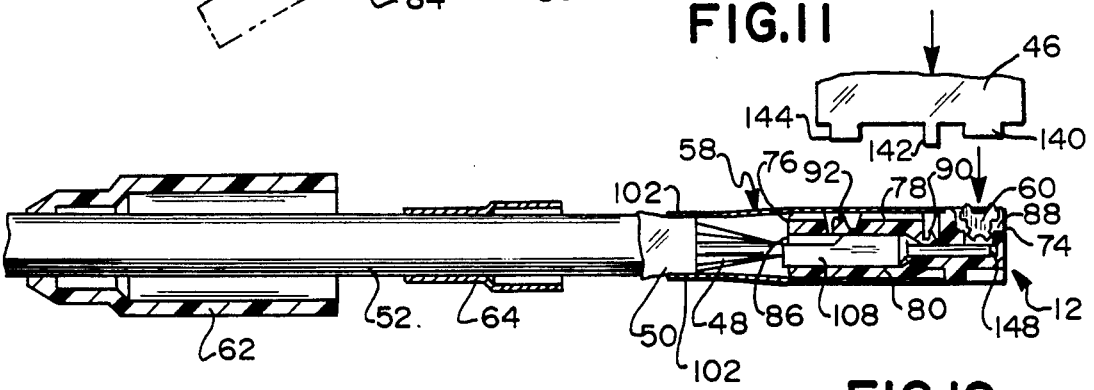
FIG. 12 is a side sectional view of the plug assembly of the present invention prior to termination thereof.
Figure 13:
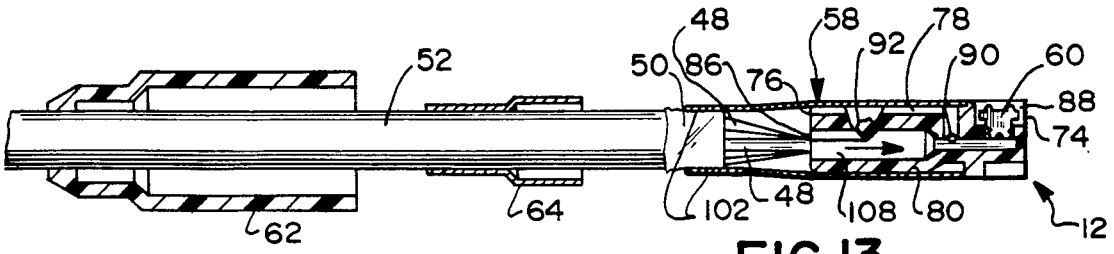
FIG. 13 is a side sectional view of the plug assembly of the present invention after termination thereof.

A plurality of terminal receiving cavities 88 are formed in the top wall 78 of the housing 56 near the front end 74 thereof. The cavities 88 communicate with the planar trough 84. The terminals 60 are mounted within the cavities 88 in such a manner so that they are movable between an initial position as best shown in FIGS. 11 and 12 to a downward or terminated position as best shown in FIGS. 6 and 13. Each terminal 60 has one end adapted to penetrate the insulated conductors 48 while th opposite end is adapted to mate with the spring mating end 40 of a receptacle contact 38.

The plug housing 56 also has a strain relief sections 90 and 92 formed in the top wall 78 thereof. The strain relief setins 90 and 92 are each deformable toward the planar trough 84 in order to engage the cable assembly 14 in response to a downward force. FIGS. 11 and 12 show the strain relief sections 90 and 92 prior to deformation while FIGS. 6 and 13 show the strain relief sections after deformation.

Figure 5:
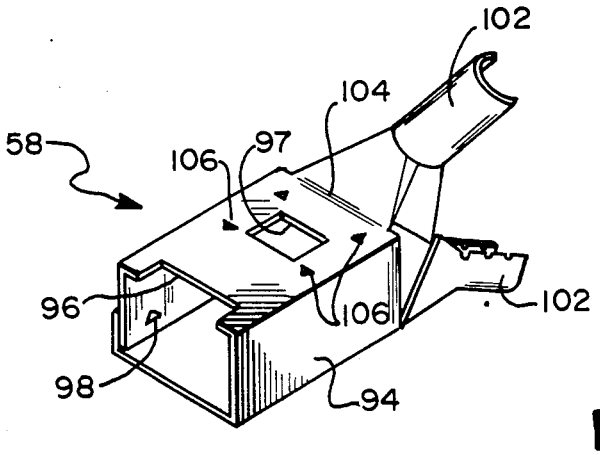
FIG. 5 is a perspective view of the connector shield which is adapted to be mounted on the housing of the plug assembly of the present invention.

Turning now to FIG. 5, the unitary metal shell 58 has a forward portion 94 which generally surrounds the top wall 78, bottom wall 80 and sidewalls 82 of the plug housing 56. Openings 96 and 97 are provided in the shell 58 to allow access to the strain relief sections 90 and 92, respectively. Interengaging tangs 98 are formed near the lateral side edges of the shell 58 to lock the shell to itself and integrity of the shell while on the housing 56.

In addition to the forward portion 94 of the shell 58, there is a converging neck portion comprising two neck members 102. Each neck member 102 is pivotally joined to the forward portion 94 by means of a coined seam lines 104 and is adapted to contact the foi1 50 of the cable assembly 14 when the plug assembly is joined thereto.

The shell 58 also includes a plurality of upstanding tangs 106 struck out of the metal. The tangs 106 are adapted to cooperate with the shield cover 62.

Initially, the metal shell 58 is mounted on the plug housing 56 by sliding it on the rear end thereof, as is best shown in FIG. 11. The neck members 102 are then spread apart by pivoting them about the seam line 104 to attain the configuration as shown in phantom in FIG. 11. The plug assembly 12 is now ready to accept the conductors 48 within the housing 56.

It is very important that the ends of the insulated conductors 48 are properly positioned within the wire receiving trough 84 so that they are aligned underneath their respective terminals 60. To this end, there is provided a wire positioning member, generally designated 108.

Figure 7A:
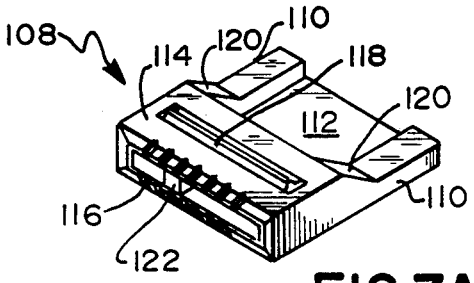
FIG. 7A is a perspective view of a wire positioning member comprising a part of the plug assembly of the present invention.
Figure 7B:
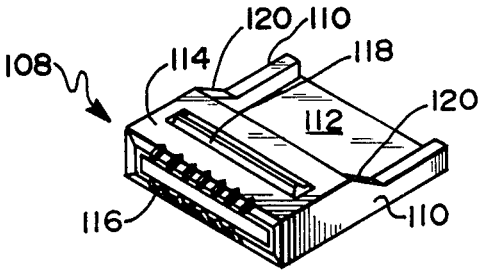
FIG. 7B is a perspective view of another wire positioning member.

As best seen in FIGS. 7A and 7B, the wire positioning member 108 generally includes two spaced-apart side walls 110, a wire support floor 112 and a top wall 114. The front edge 116 of the wire positioning member 108 defines a reference line from which the ends of the insulated conductors 48 extend.

The distance between the facing interior surfaces of the side walls 110 of the wire positioning member 108 is substantially equal to the sum of the outside diameters of the insulated conductors 48 which are to be received therein. It is desireable to accommodate different numbers of conductors 48 within the same size housing 56. Accordingly, different wire positioning members 108 can be provided which will fit into the same trough 84 but will fit a different number of conductors 48. For example, FIGS. 7A and 7B illustrate two different wire positioning members 108 having the same overall outside dimensions. Therefore, the wire positioning members of FIGS. 7A and 7B will fit into the same trough 84. The side walls 110 of the wire positioning member of FIG. 7A are thicker than those of FIG. 7B. Thus, the wire positioning member 108 of FIG. 7B will accommodate a greater number of conductors 48 than that of FIG. 7A.

The top wall 114 of the wire positioning member 108 has a deformable portion 118 molded therein. The deformable portion 118 is movable toward the wire support floor 112 in response to a downward force.

Each side wall 110 slants downwardly from the top wall 114 toward the rear of the wire positioning member 108. The transition between these two heights defines a slanted surface 120 which will ultimately engage strain relief section 92 for purposes which will become more apparent hereinafter.

The wire positioning member 108 can be modified as shown in FIG. 7A so that an intermediate conductor can be eliminated in the plug assembly 12. it is assumed that the member 108 shown in FIG. 7A accommodates four conductors 48 and it is desired to have only 3 conductors 48 connected to terminals 60. In order to accomplish the stated goal, the positioning member 108 is integrally molded with a dummy portion 122 that has the same width of an insulated conductor 48 and positioned in the same location between the top wall 114 and floor 112 that the missing conductor would have otherwise occupied. One conductor 48 would be positioned on one side of the dummy portion 122 while the other two conductors would be positioned on the other side of the dummy portion. The terminal 60 that would normally pierce a conductor positioned where the dummy portion 122 is located, can either be seated downwardly into its cavity 88 or eliminated altogether.

Figure 9:
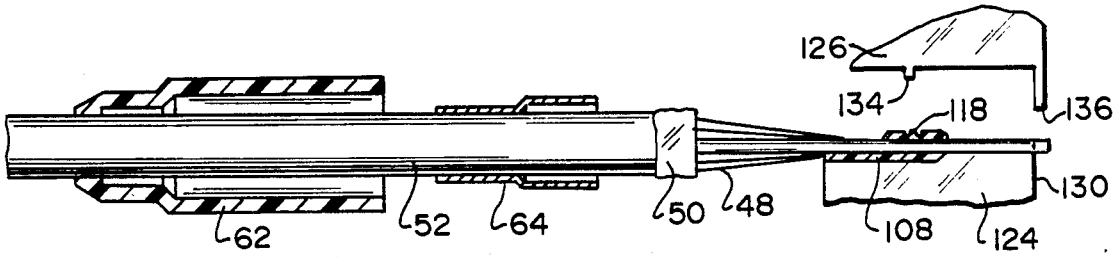
FIG. 9 is a side sectional view of the cable assembly of FIG. 8 prior to the operation of the tool.

After the cable conductors 48 of assembly 14 are positioned within a wire positioning member 108 (FIG. 9), it is placed within a nest 124 of a press as is best shown in FIG. 8. The wire positioning member 108 is properly positioned in the press when the front edge 116 thereof abuts against a stop 128. A cutting edge 130 is provided spaced from the front edge 116 of the wire positioning member 108.

It is to be noted that ultimately the distance each conductor 48 end extends past the front edge 116 of the wire positioning member 108 is necessarily the same distance before being inserted into the plug housing 56. Initially, it is only required that each insulated conductor 48 extend past the cutting edge 130.

Figure 10:
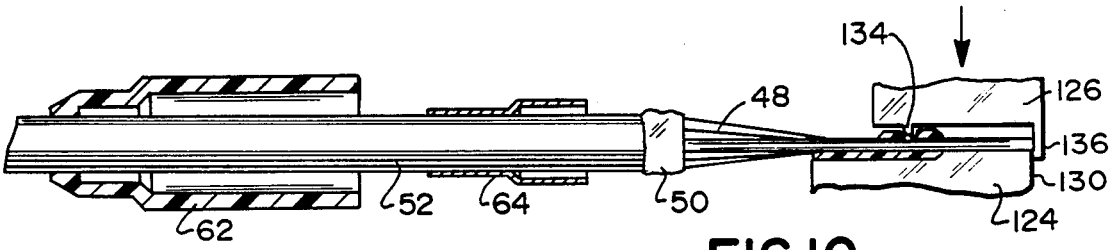
FIG. 10 is a side sectional view of the cable assembly of FIG. 9 after operation of the tool.

The press has an overhead ram, generally designated 132, which includes a punch 134 and a cut-off blade 136. When the ram 136 is actuated, it is driven downwardly so that the punch 134 engages the top wall portion 118 to deform it against the conductors 48 while, at the same time, the cut-off blade 136 cuts the ends of the conductors 48 against the edge 130, as best shown in FIG. 10.

The finished wire positioning member subassembly firmly holds the conductors 48 in place. In addition, the ends of each conductor 48 are cut off precisely a predetermined distance from the front edge 116 of the wire positioning member 108. The wire positioning member subassembly thus described is ready to be inserted through the wire receiving opening 86 into the planar trough 84, as best shown in FIG. 11, in order to get to the configuration shown in FIG. 12.

The plug assembly 12 is then placed on a suitable applicatin tool (not shown) which is well known in the art. The tool has a terminal engaging punch 140, a front strain relief engaging punch 142 and a rear strain relief engaging punch 144 all mounted on a downwardly actuable ram, generally designated 146. When actuated, the ram 146 moves downwardly such that the following occurs:

1. Punch 144 engages strain relief section 92 and deforms it downwardly so that its outer lateral edges thereof first engage cam surface 120. This moves the entire wire positioning member 108 and the pinched conductors 48 secured therein forwardly to fill up the empty area 148 in the most forward part of trough 84. Upon further downward movement, the strain relief section 92 pinches conductors 48 against the wire support floor 112 of the wire positioning member 108.

2. Punch 142 engages the other strain relief section 90 and deforms its downwardly to pinch the conductors 48 against the trough 84 in front of the wire positioning member 108.

3. Punch 140 drives terminals 60 downwardly to pierce conductors 48 to provide electrical contact therewith.

Immediately after actuation of the ram 146, the plug assembly 112 attains the configuration as shown in FIG. 13.

The ring member 64 is then slid forwardly so that forward portion thereof surrounds the neck members 102 of the shell 58. A suitable circular crimping tool which is well known in the art is used to crimp the portion surrounding the neck members 102 to connect the shell 58 will the foil 50. The shield cover 62 is then moved forwardly over the crimped ring member 64 so that recesses 70 of the shield cover 62 engage upstanding, struck-out tangs 106 formed on the front portion 94 of the metal shell 58. This securely holds the shield cover 62 onto the shell 58 to complete the assembly of the plug assembly 12.

Plug assembly 12 is now ready for insertion into the opening 24 of the receptacle 16 socket, as is best shown in FIGS. 1 and 6.

We claim:

1. A plug assembly for connecting multiconductor cable assembly to a receptacle, said multiconductor cable assembly including a plurality of insulated conductors surrounded by an outer insulation jacket, said plug assembly being of the type including an insulated housing having a front mating end and a rear wire receiving end joining opposing top and bottom walls and an opposing pair of side walls and further including a generally planar trough extending from a wire receiving opening in the rear end towards the front end of the housing, and a plurality of terminal receiving cavities extending from the top wall into said trough near the front end thereof and a strain relief section formed in the top wall between the terminal receiving cavities and the rear end and extending generally over the width of the trough and deformable downwardly into the trough upon receiving a downward force, insulative wire positioning means received through the wire receiving opening into the trough and holding said insulated conductors in an array so that the ends thereof are presented in alignment below said terminal receiving cavities when the wire loaded positioning means is in the housing trough, and a plurality of insulation penetrating terminals mounted in the terminal receiving cavities and moveable toward the trough to engage the conductors aligned thereunder;

the improvement comprising:

said positioning means includes cam means formed thereon adapted to engage said housing strain relief section when it is moved downwardly, whereby said positioning means is moved forwardly in the trough to fully seat the positioning means therein and position the free ends of the insulated conductors below said terminals.

2. The plug assembly of claim 1 wherein said positioning means is a unitary molded article including two spaced-apart side walls, a wire support floor defined between the opposed facing surfaces of the side walls, top wall means spaced from said floor, wherein said top wall means is deformable towards the wire support floor in response to a downward force to hold said conductors in a generally planar array in proper position therebetween.

3. The plug assembly of claim 2 wherein the distance between the facing interior surfaces of the side walls of the positioning means is substantially equal to the sum of the outside diameters of the number of insulated conductors to be terminated.

4. The plug assembly of claim 3 wherein said cam means is formed on the side walls of the positioning means.

5. The plug assembly of claim 4 wherein said cam means is an upwardly facing slanted surface formed on each side wall adapted to slidingly engage said strain relief section as it is moved downwardly.

6. The plug assembly of claim 2 wherein multiconductor cable includes a cable shield within said jacket surrounding said conductors, said plug assembly including conductive connector shield means mounted on and generally surrounding at least the top wall, bottom wall and sidewalls of the housing, said connector shield means including a generally converging neck portion extending rearwardly of said housing and surrounding said cable and adapted to contact said cable shield.

7. The plug assembly of claim 6 including a conductive ring member adapted to be crimped around the neck portion of the connector shield means to mechanically secure the cable to the plug housing and provide strain relief therefor.

8. A shielded plug assembly for connecting a shielded multiconductor cable assembly to a receptacle, said shielded multiconductor cable assembly including a plurality of insulated conductors received within a cable shield and surrounded by an outer insulation jacket, said shielded plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, a plurality of insulation penetrating terminals mounted in the terminal receiving cavities and moveable toward the trough to engage the conductors aligned thereunder, conductive connector shield means mounted on and generally surrounding at least the top wall, bottom wall and sidewalls of the housing, said connector shield means including a generally converging neck portion extending rearwardly of said housing and surrounding said cable and adapted to contact said cable shield, and a ring member adapted to be crimped around the neck portion of the connector shield means to mechanically secure the cable to the housing and provide a strain relief therefor and to electrically connect the cable shield to the connector shield means, the improvement comprising:

said connector shield means includes an open ended, laterally enclosed, unitary, stamped metal shell slidingly mounted on said housing, said housing and metal shell having detent means for accurately locating the shell on the housing.

9. The plug assembly of claim 8 wherein said detent means and housing includes mating pairs of interengaging projections and depressions.

10. The plug assembly of claim 8 wherein said neck portion includes a pair of opposed generally semicylindrical neck members, each member being joined to the shell by means of a weakened coined seam line, whereby said neck members are pivotable about said seam line away from each other to provide clearance for the cable assembly received therebetween.

11. The plug assembly of claim 8 including a integrally formed outer shield cover mounted over the connector shield means, said shield cover having a rear cable receiving opening at the end of a rear portion which snuggly fits around at least a portion of the ring member joining a larger forward portion which encloses at least a portion of the shell.

12. The plug assembly of claim 11 further including a pair of cantilevered, latch arms, one latch arm joining each housing sidewall and extending outwardly and rearwardly therefrom, the free ends of said latch arms being resiliently moveable toward and away from the respective side wall, said shield cover having opposed slots formed in the forward portions to provide clearance for the free ends of the latch arms.

13. The plug assembly of claim 11 including interengaging locking means cooperating between the shield cover and the connector shield means to lock the cover on the shield means and providing additional strain relief for the cable assembly.

14. A method of producing a shielded plug assembly for connecting a shielded multiconductor cable assembly to a receptacle, said multiconductor cable assembly including a plurality of insulated conductors received within a cable shield and surrounded by an outer insulation jacket, said shielded plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, a plurality of insulation penetrating terminals mounted in the terminal receiving cavities and moveable toward the trough to engage the conductors aligned thereunder, conductive connector shield means mounted on and generally surrounding at least the top wall, bottom wall and sidewalls of the housing, said connector shield means including a generally converging neck portion extending rearwardly of said housing and surrounding said cable and adapted to contact said cable shield, and a ring member adapted to be crimped around the neck portion of the connector shield means to mechanically secure the cable to the housing and provide a strain relief therefor and to electrically connect the cable shield to the connector shield means;

the method including the steps of:

(a) providing the housing with the terminals loaded in the cavities in a nonterminated position;

(b) stripping a portion of the insulation jacket from the cable to expose the cable shield and the insulated conductors;

(c) positioning the wire conductors into said array;

(d) positioning the array into the positioning means so that all of the ends of the conductors extend forwardly of said positioning means at a first predetermined distance;

(e) holding said array relative to said positioning means;

(f) inserting the positioning means into the housing trough so that the conductor ends are generally below and aligned with said terminals;

(g) terminating the conductors by imparting a downward force on the terminals to move them downwardly into the trough to engage said conductors;

(h) mounting the connector shield means on the housing; the improvement in said method comprising performing the following steps prior to terminating the conductors:

(1) stamping and forming said connector shield means to produce an open ended, laterally enclosed, unitary metal shell with the neck portion including a pair of semi-cylindrical neck members joined to the shell by means of a weakened coined seam line;

(2) sliding the shell onto the housing and pivoting said neck members away from each other about the respective seam lines;

(3) providing a unitary positioning means including two spaced-apart side walls, a wire support floor defined between the opposed interior surfaces of the side walls and top wall means spaced from said floor;

(4) positioning the array so that it is generally planar and all of the ends of the conductors extend forwardly of said positioning means at least said predetermined distance;

(5) cutting the planar array said predetermined distance from said positioning means; and (6) inserting said positioning means between said spread-apart neck members into said trough.

15. The method of claim 14 wherein a portion of said positioning means is deformed against the planar array to hold said array in position relative thereto.

16. the method of claim 14 including moving the spread apart neck members toward wach other after the positioning means is inserted into the trough.

17. A method of producing a plug assembly for connecting multiconductor cable assembly to a receptacle, said multiconductor cable assembly including a plurality of insulated conductors surrounded by an outer insulation jacket, said plug assembly being of the type including an insulated housing having a front mating end and a rear wire receiving end joining opposing top and bottom walls and an opposing pair of side walls, and further including a generally planar trough extending from a wire receiving opening in the rear end towards the front end of the housing, and a plurality of terminal receiving cavities extending from the top wall into said trough near the front end thereof, insulative wire positioning means received through the wire receiving opening into the trough and holding said insulated conductors in an array so that the ends thereof are presented in alignment below said terminal receiving cavities when the wire loaded positioning means is in the housing trough, a plurality of insulation penetrating terminals mounted in the terminal receiving cavities and moveable toward the trough to engage the conductors aligned thereunder, the method including the steps of:

(a) providing the housing with the terminals loaded in the cavities in a nonterminated position;

(b) stripping a portion of the insulation jacket from the cable to expose the insulated conductors;

(c) positioning the wire conductors into a planar array;

(d) positioning the array into the positioning means so that all of the ends of the conductors extend forwardly of said positioning means at a first predetermined distance;

(e) holding said array relative to said positioning means;

(f) inserting the positioning means into the housing trough so that the conductor ends are generally below and aligned with said terminals; and (g) terminating the conductors by imparting a downward force on the terminals to move them downwardly into the trough to engage said conductors;

the improvement in said method comprising performing the following steps prior to terminating the conductors:

(1) providing a unitary positioning means including two spaced-apart side walls, a wire support floor defined between the opposed interior surfaces of the side walls and top wall means spaced from said floor;

(2) positioning the array so that it is generally planar and all of the ends of the conductors extend forwardly of said positioning means at least said predetermined distance; and (3) cutting the planar array said predetermined distance from said positioning means and simultaneously deforming said positioning means to positively hold said conductor ends in said planar array.

18. The method of claim 17 wherein a portion of said positioning means is deformed against the planar array to hold said array in position relative thereto.

19. The method of claim 17 wherein said positioning means is formed with a dummy portion at the location where a conductor would be located and said positioning step includes positioning the conductors on both sides of the dummy portion.

* * * * *